US006631677B1

(12) United States Patent
Fuhrmann et al.

(10) Patent No.: US 6,631,677 B1
(45) Date of Patent: Oct. 14, 2003

(54) PRINTING MACHINE WITH AN IMAGING DEVICE

(75) Inventors: Hartmut Fuhrmann, Bobingen (DE); Dirk Probian, Augsburg (DE); Roland Höll, Weiterstadt (DE); Klaus Peter Reichardt, Bad Vilbel (DE); Karsten Wendt, Obertshausen (DE); Thomas Weiss, Hainburg (DE); Albrecht Völz, Rödermark (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 790 days.

(21) Appl. No.: 09/042,520

(22) Filed: Mar. 16, 1998

(30) Foreign Application Priority Data

Mar. 14, 1997 (DE) ..... 197 10 520

(51) Int. Cl.[7] ..... B41M 5/00
(52) U.S. Cl. ..... 101/181; 101/401.1; 101/463.1
(58) Field of Search ..... 101/401.1, 456, 101/463.1, 465–467, 457, 395; 399/364; 430/330, 346, 347, 300, 301–307

(56) References Cited

U.S. PATENT DOCUMENTS 3,867,150 A * 2/1975 Ketley ..... 96/36.3
4,383,261 A * 5/1983 Goldberg ..... 346/1.1
4,395,946 A 8/1983 Price
4,654,864 A 3/1987 Ichiyoshi
4,854,696 A * 8/1989 Guez ..... 352/90
5,351,617 A * 10/1994 Williams et al. ..... 101/467
5,526,107 A * 6/1996 Bronstein ..... 355/327
5,557,465 A * 9/1996 Ito et al. ..... 359/669
5,642,182 A * 6/1997 Nishioka et al. ..... 355/55
5,713,287 A * 2/1998 Gelbart ..... 101/467

FOREIGN PATENT DOCUMENTS

| | | |
|---|---|---|
| DE | 195 12 420 | 10/1996 |
| DE | 195 23 378 | 1/1997 |
| WO | WO 97/02143 | 1/1997 |

* cited by examiner

*Primary Examiner*—Eugene H. Eickholt
(74) *Attorney, Agent, or Firm*—Cohen, Pontani, Lieberman & Pavane

(57) ABSTRACT

A printing machine that has a plurality of form cylinders and in which an imaging device images at least two of the form cylinders. The imaging device is arranged in stationary fashion. Laser pulses are deflected onto the form cylinders by light diversion components.

20 Claims, 2 Drawing Sheets

PRINTING MACHINE WITH AN IMAGING DEVICE

BACKGROUND OF THE INVENTION

1. Field of the Invention

The invention relates to a printing machine with at least two form cylinders for printing on a printing stock.

2. Discussion of the Prior Art

From U.S. Pat. Nos. 3,654,864 and 4,395,946, printing machines are known, each of which has a printing group and an imaging device. Because the imaging device, which has a laser, is arranged inside the printing machine, it is not necessary to place the printing forms into the printing machine after imaging to allow the printing process to be carried out.

From German reference DE 43 28 058 A1, printing machines are known with multiple printing groups and respective associated imaging units. In addition, the aforementioned reference depicts printing machines with drum storage units, in which a single imaging unit can image a plurality of form cylinders equipped with printing forms when the form cylinders, which have been removed from the printing machine by means of a pivoting mechanism, are arranged in the rotatable drum storage device. In another printing machine with multiple printing groups, also described in DE 43 28 058 A1, the form cylinders are removed from the printing groups by means of grippers and can then be seized by a trolley arranged on a rail that runs in the longitudinal direction of the printing machine. The trolley transports the cylinders either to an exchange device or, if the form cylinder has a renewable printing form, to an erasure and imaging device that re-images the form cylinder. After this, the form cylinder must be transported by the trolley back to the grippers, and the grippers must place the printing form back into the proper printing group.

The known methods of imaging a plurality of form cylinders thus have the disadvantage that a large number of movement steps are needed to remove the form cylinder from its mounting and, after the imaging process, to put the form cylinder back into its mounting. This procedure is not only time-consuming, but also places high demands on mechanical precision during these steps and requires that the transport steps take up relatively little time, compared with the duration of the exposure.

From German reference DE 195 12 420 A1, a sheet-fed printing machine is known with multiple form cylinders that are imaged by a single printing head. For this purpose, the printing head must be moved up to the form cylinders, one after the other, in a straight or curved line. Once again, the difficulty arises of attaining high mechanical accuracy, so that the printing forms on the form cylinders are always imaged on the same locations.

From German reference DE 195 23 378 A1, a generic printing machine is known, in which two form cylinders can be imaged by a single imaging system. The imaging system is pivoted as a unit by means of a pivoting mechanism so that both form cylinders can be imaged.

SUMMARY OF THE INVENTION

The object of the present invention is to further develop a printing machine of the type mentioned above so as to avoid mechanical inaccuracies that arise due to the transversal movement of the form cylinders or of the printing head or due to the pivotal movement of the imaging system as a whole.

Pursuant to this object, and others which will become apparent hereafter, one aspect of the present invention resides in a printing machine comprised of at least two form cylinders, at least one imaging device having a laser unit operative to emit laser pulses for imaging printing forms on the form cylinders, and light diversion means for selectively deflecting the laser pulses produced by the laser unit onto one of the at least two form cylinders.

According to the invention, light diversion means are used to optionally divert the laser pulses generated by the laser unit to one of the two or more form cylinders. The light diversion means are, for example, mirrors, prisms or optical waveguides, by means of which the laser pulse can be diverted in accordance with the curvature of the optical waveguides in any desired spatial direction.

In another embodiment of the invention the light diversion elements are associated with multiple form cylinders by pivoting, tilting or moving devices.

In yet another embodiment of the invention the laser is a semi-conductor laser.

An optical path is formed between the laser unit and the form cylinders, and optical wave guides can be arranged in this optical path.

In still another embodiment of the invention an imaging device is arranged between the form cylinders. The light diversion means, in a further embodiment can include a mirror, a prism, a system of image-forming lenses, a holographic screen or a rotary device for rotating an end of an optical wave guide directable to a surface to be printed.

In yet another embodiment of the invention a beam bundle formed by the imaging device is pivotable by the light diversion means so that the beam bundle can be directed alternately onto the circumferential surfaces of respective ones of the form cylinders.

In still another embodiment of the invention the laser unit has a modulator associated with it or the laser unit itself can be modulated.

Yet a further embodiment of the invention has a preheating unit associated with one of the form cylinders so as to heat a material on the surface of the form cylinder to be imaged to an energy level slightly below an energy level needed for application of image information. The needed level is only exceeded by the laser pulses.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
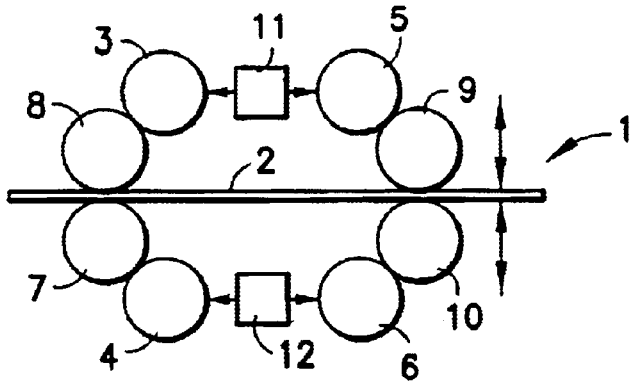
FIG. 1 schematically depicts a printing machine for printing a printing web using the blanket-to-blanket method.

A printing machine 1 is shown in FIG. 1 for printing on both sides of a printing web 2, and has form cylinders 3 to 6. The form cylinders 3 to 6 have, for example, a surface that can be imaged and then erased after completion of the printing process. In a different embodiment, the form cylinders 3 to 6 are equipped with at least one printing plate or one printing film each, and the printing films and the printing plates are preferably erasable. The printing forms are, for example, either metal plates, in particular, process-free printing forms, or plastic films, which preferably can be further transported by means of a winding device arranged inside the form cylinders 3 to 6 after a portion located on the surface of the form cylinders 3 to 6 is printed. Form cylinders of this type embodied as winding cylinders are known, for example, from German references DE 43 03 872 A1, DE 44 29 210 A1 and DE 44 32 817 A1. The form cylinders 3 to 6 can also be covered with multiple printing plates or printing films located next to or behind each other. Instead of using printing plates with a beginning and an end, it is also possible to use endless sleeves as printing forms. During imaging, for example, there is a change in the surface property from "hydrophilic" to "hydrophobic" or vice versa. So that less laser energy is needed for this change in surface property, a preheating device can be used to preheat the printing forms before they are imaged by the laser pulses. Similarly, material can be fixed on the surface of the form cylinder with a preheating or a postheating device. The preheating or postheating device traverses the form cylinder either together with the laser unit or independent thereof. The transfer cylinders 7 to 10 are covered with rubber blankets (rubber blanket cylinders). At two printing locations opposite to each other, the printing web 2 is printed by the transfer cylinders 7, 8 or 9, 10 using the so-called blanket-to-blanket method.

Associated with the form cylinders 3, 5 and the form cylinders 4, 6 are the shared imaging devices 11, 12, respectively. The imaging devices 11, 12 themselves are arranged in stationary fashion. They each comprise, for example, a printing head on a spindle, e.g., a threaded spindle, which is movable by means of a step motor parallel to the longitudinal axes of the form cylinders 3 to 6. The imaging device comprises a laser unit with a single laser, e.g., a YAG laser, or with a plurality of semi-conductor laser diodes, modulators and focusing means for focusing the laser pulses generated by the laser or lasers onto the surface of the form cylinders 3 to 6. When semi-conductor lasers are used, they are modulated, for example, by a change in the drive current. In the printing head, a light diversion means is arranged rotatably around the vertical axis, so that the light pulses generated by the printing head, instead of falling on the form cylinders 5 or 6, fall on the form cylinders 3 or 4. The light diversion means is, for example, a mirror, a prism, a holographic screen or a system of image-forming lenses. The light diversion means can also be associated with one of the form cylinders 3 or 4 by means of a pivoting, tilting or moving device. In the embodiment in FIG. 1, it is also possible for the form cylinders 3 to 6 to be imaged by a single imaging device 11 or 12. For this purpose, during imaging, no printing stock should be present between the rubber-blanket cylinders 7 to 10, and the light diversion means in the single printing head in the imaging unit 11 or 12 must be tiltable, pivotable or movable so that the modulated light pulses fall in a focused manner on the outer circumferential surfaces of the form cylinders 3 to 6. The laser beam produced by each of the laser units can be divided by a beam divider or another optical divider, for example, a semi-permeable mirror, a holographic screen, a prism or a system of image-forming lenses, into two or more partial beams, each of which is modulated individually by a modulator and directed via focusing means, e.g., a converging lens, onto the surfaces of the form cylinders 3 to 6 to be imaged. The form cylinders 3 to 6 are imaged while rotating and being traversed by the printing head or printing heads. The form cylinders to be imaged can also be arranged one below the other.

Figure 3:
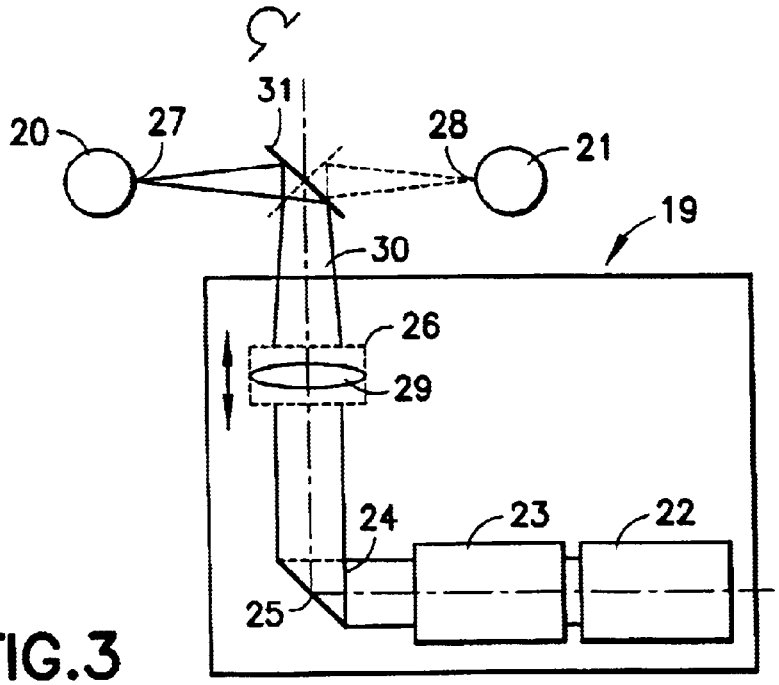
FIG. 3 shows two form cylinders that can be imaged by a single light source by adjusting a mirror.

According to the invention, light diversion means, for example, a mirror 31, which is turned in such a way that the light pulses are diverted, as shown in FIG. 3 in reference to another embodiment, are arranged in the imaging devices 11, 12. The arrows in FIG. 1 indicate that the printing web 2 can be printed either by the rubber blanket cylinders (transfer cylinders) 7, 8 or the rubber blanket cylinders (transfer cylinders) 9, 10 in 1/1 printing or, if all four rubber blanket cylinders (transfer cylinders) 7 to 10 are in position, in 2/2 printing. In the event that only two transfer cylinders are positioned on the printing web, the form cylinders 3 to 6 belonging to the other respective rubber blanket cylinders are imaged by means of the imaging devices 11, 12, so that printing is carried out alternately with the form cylinders 3 and 4 or with the form cylinders 5 and 6. The alternating method of 1/1 printing is also suitable when the form cylinders 3 to 6 are equipped with conventional non-erasable printing forms.

Figure 2:
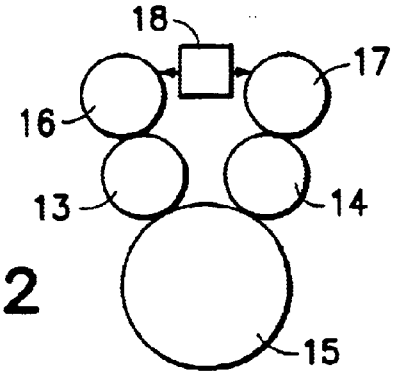
FIG. 2 is a printing machine with two form cylinders associated with a single printing cylinder.

In the embodiment shown in FIG. 2, two rubber blanket cylinders 13, 14 are positioned on a double-large printing cylinder 15. The rubber blanket cylinders 13, 14 interact with form cylinders 16, 17. In this case, too, the form cylinders 16, 17 can be imaged by a common imaging device 18. The imaging device 18 is arranged in stationary fashion and has a printing head on a spindle that is movable parallel to the longitudinal axes of the form cylinders 16, 17. The printing head has associated with it, for example, a mirror rotatable by 90 degrees around a vertical axis, so that both the form cylinder 16 and the form cylinder 17 can be imaged by the imaging device 18.

According to the embodiment in FIG. 2, the imaging of the form cylinders 16, 17 is carried out consecutively. In a different embodiment, two printing heads are arranged on the imaging device 11 or 12 and can simultaneously image two of the form cylinders 3 to 6 during simultaneous movement on a traverse parallel to the longitudinal axes of the form cylinders 3 to 6.

In the embodiment shown in FIG. 3, there is an imaging device 19 for imaging form cylinders 20, 21 is provided. The imaging device 19 comprises a laser 22, which is, for example, a solid laser, a gas laser or a semi-conductor laser or comprises a laser unit 22 with a plurality of lasers. Arranged in front of the laser 22 is a modulator 23, which comprises, for example, a plurality of individual modulators. The modulators work either electro-optically or acousto-optically. Alternatively, the laser or the laser unit itself is modulated. In the latter case, light pulses corresponding to the printing information are produced from the continuous laser beams. A modulator 23 of this type is known from German reference DE 196 02 289 A1. The beam path 24 of the light pulses emerging from the modulator 23 is diverted by a mirror 25 and reaches an autofocus system 26, which serves to adjust the position of the focal point of the beam bundle 30. The focal point must agree with the incidence points 27, 28 of the beam bundle 30 on the form cylinders 20, 21. The autofocus system 26 has at least one convex lens 29, and preferably comprises a plurality of lenses. Autofocus systems for use in printing devices are known, for example, from WO 92/16374. The beam bundle 30 emerging from the autofocus system 26 is diverted by the mirror 31 either onto the circumferential surface of the form cylinder 20 or onto the circumferential surface of the form cylinder 21. The mirror 31 is therefore tiltable by 90 degrees around an axis parallel to the longitudinal axes of the form cylinders 20, 21. In addition, the mirror 31 can be moved either together with the printing head or alone on a line parallel to the longitudinal axes of the form cylinders 20, 21. When a parallel beam bundle is used, it may be sufficient to move only the mirror 31 and the focusing device 26. In this way, it is possible, when the form cylinders 20, 21 rotate during the imaging process, to image the entire circumferential surface of the form cylinders 20, 21 by means of the beam bundle 30.

Instead of the single autofocus system 26, it is also possible to provide autofocus systems that are arranged, respectively, between the mirror 31 and the form cylinders 20 and 21, so that each of the form cylinders 20, 21 has its own autofocus system. Mirroring components and image-forming components in the beam path of the beam bundle 30 can also be constructed in a unit with the autofocus system. Depending on the definition depth of the optical system, the focusing device does not necessarily have to be an autofocusing unit. If length differences in the optical path are created during the changeover of the mirror 31 from the form cylinder 20 to the form cylinder 21 or vice versa, and these length differences are not compensated for by the available focusing devices, e.g., the autofocus system, a movement unit can be provided, which causes the required position change of the imaging device 19 as a whole. It is possible for a movement unit of this type to move the imaging unit 19 perpendicularly to the longitudinal axes of the form cylinder 20, 21. The positional accuracy must thereby be matched to the tolerances of the optical system.

In a further embodiment, not shown here, the imaging device 19 (for example, as shown in FIG. 3) is constructed in a stationary but rotatable fashion on a plate between the form cylinders 20, 21. This means that after one of the two form cylinders 20, 21 has been imaged, the imaging device 19 is rotated by 180 degrees, so that the other of the two form cylinders 20, 21 can be exposed. The position of the focal plane of the beam bundle 30 is pre-adjusted by the rotary device and, if necessary, by a movement device as well.

The optical path on which the light pulses can be transmitted may run in air or in an optical waveguide. The light pulses emerging from the modulator 23 or the semiconductor lasers are then transported via an optical waveguide, for example, to the mirror 31. Instead of the mirror 31, however, an optical switch can be provided, to which two optical waveguides are attached on the output side. Depending on the position of the optical switch, light pulses are then fed either to the first optical waveguide facing the form cylinder 20 or to the second optical waveguide facing the form cylinder 21. Instead of passing through the optical waveguides, the laser pulses can pass through air. As a result, the necessity of rotating a mechanical element, such as the mirror 31, can be avoided. In this case, only one movement device is required, which moves the ends of the optical waveguides attached to the optical switch, together with the focusing unit, along the circumferential surfaces of the form cylinders 20, 21. It is possible, by suitable control of the modulator 23 and the optical switch, to generate pulses in alternation for one and then for the other form cylinder 20, 21, so that, when the two form cylinders 20, 21 rotate simultaneously, both form cylinders 20, 21 can be imaged by a single mechanical movement step. Instead of the structure shown in FIG. 3, it is also possible, for example, for multiple form cylinders to be arranged one below the other, and for their printing forms to be imaged by suitable deflection, by means of an optical switch, of the light pulses generated by a single traversing laser unit. This can also be carried out using the multiplex method.

As an alternative to using an optical switch, it is also possible for the output-side end of the optical waveguide to be rotatable back and forth, together with the focusing device, between the two form cylinders 20, 21. This presumes that the optical waveguide is sufficiently elastic. The focusing devices are, for example, autofocus systems.

Figure 4:
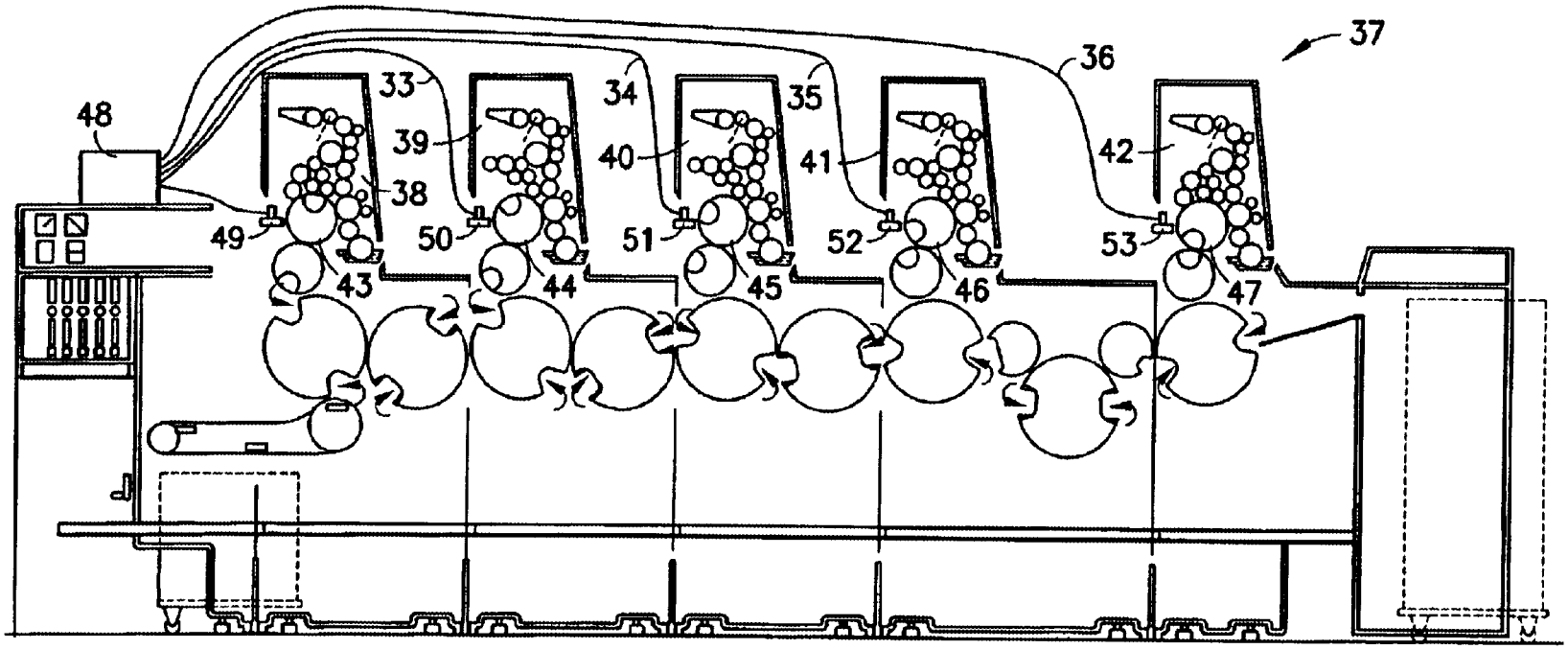
FIG. 4 depicts a printing machine with a plurality of printing groups, whose form cylinders can be imaged by a single light source or by multiple light sources via optical waveguides.

It is also possible to use optical waveguides with a printing machine 37, as shown in FIG. 4. The printing machine 37 is a sheet-fed printing machine with five printing groups 38 to 42. Each of the printing groups 38 to 42 is equipped with a form cylinder 43, 44, 45, 46 or 47. A laser unit, which can comprise one or more lasers, is associated via the optical waveguides 32 to 36 with one or more of the form cylinders 43 to 47. The particular association is selected via an optical switch. The light emitted by the laser unit is modulated either by the modulation of the laser diodes or by modulators that are associated with the individual optical waveguides 32 to 36.

By means of the optical switch, which is preferably arranged between the modulator or the waveguide-side outputs of the laser diodes, on the one hand, and the inputs of the optical waveguides 32 to 36, on the other, it is also possible to couple the light pulse into the optical waveguides 32 to 36, using the multiplex process, so that the form cylinders 43 to 47 can be imaged synchronously. In this case, the output-side ends of the optical waveguides 32 to 36 are arranged, in conjunction with focusing devices, on tables 49 to 53 or threaded spindles that are movable laterally along the form cylinders 43 to 47. Instead of a single modulator arranged in the imaging device 48, modulators associated individually with the form cylinders 43 to 47 can be provided on the movable tables 49 to 53.

The invention creates a printing machine 1, 37 that has a plurality of form cylinders 3 to 6; 16, 17; 43 to 47 and in which an imaging device 11, 12; 18; 48 images at least two form cylinders 3, 5; 4, 6; 16, 17; 43 to 47. The imaging device 11, 12; 18; 48 is arranged in stationary fashion.

The form cylinders 3 to 6; 16, 17; 43 to 47 are either covered with conventional printing plates or, preferably, have an erasable printing form surface. Furthermore, process-free printing forms, e.g., printing plates or printing films, are also suitable. If the printing plates or printing films are erasable, fixing devices for fixing the printing image produced on the circumferential surface of the form cylinders 3 to 6; 16, 17; 43 to 47, as well as stations for the application of the imaging material, are also necessary, in addition to the imaging devices 11, 12; 18; 48. The imaging material is a transfer material or a polymer, for example, which changes its surface properties due to laser radiation. For example, there are polymers that can be made hydrophilic or hydrophobic by means of laser radiation. Further, an erasing device for erasing an erasable printing form can be provided.

The imagining devices 11, 12, 18, 48 can be used in any type of printing machine, i.e., in printing machines for direct or indirect printing, for flat-bed printing or gravure printing.

The invention is not limited by the embodiments described above which are presented as examples only but can be modified in various ways within the scope of protection defined by the appended patent claims.

We claim:

1. A printing machine, comprising:

at least two form cylinders;

a stationary imaging device having a laser unit operative to emit laser pulses in a beam bundle along a beam path for imaging printing forms on the form cylinders; and light diversion means movable in the beam path for dividing the beam bundle into partial beams and selectively deflecting the laser pulses produced by the laser unit onto one of the at least two form cylinders.

2. A printing machine as defined in claim 1, wherein the light diversion means includes light diversion elements movably arranged in the beam path so that the elements can be associated with multiple form cylinders.

3. A printing machine as defined in claim 1, wherein the laser is a semi-conductor laser.

4. A printing machine as defined in claim 1, and further comprising an optical waveguide arranged in the beam path.

5. A printing machine as defined in claim 1, wherein the imaging device is arranged between the form cylinders.

6. A printing machine as defined in claim 1, wherein the light diversion means is arranged between the form cylinders so as to pivot the beam bundle so that the beam bundle can be directed alternately onto circumferential surfaces of respective ones of the form cylinders.

7. A printing machine as defined in claim 1, wherein the light diversion means includes a beam divider.

8. A printing machine as defined in claim 5, wherein the light diversion means includes one of the group consisting of a mirror, a prism, a system of image-forming lenses, a holographic screen, and a rotary device for rotating an end of an optical waveguide directable toward a surface to be printed.

9. A printing machine as defined in claim 1, and further comprising means, arranged in a beam path of the laser pulses, for focusing the pulses.

10. A printing machine as defined in claim 9, wherein the focusing means is an autofocus system.

11. A printing machine as defined in claim 1, wherein the light diversion means includes an optical switch operatively arranged to alternatively direct the laser pulses toward circumferential surfaces of the form cylinders.

12. A printing machine as defined in claim 11, wherein the optical switch is an acousto-optical deflector.

13. A printing machine as defined in claim 1, and further comprising a modulator arranged in the beam path on an output side of the laser unit.

14. A printing machine as defined in claim 1, and further comprising printing heads laterally movable along longitudinal axes of the form cylinders, the imaging device being a central imaging device arranged so as to image a plurality of form cylinders, the light diversion means including optical waveguides arranged to conduct the laser pulses to the printing heads.

15. A printing machine as defined in claim 14, wherein the imaging device includes a modulator and an optical switch arranged in the beam path so that the laser pulses can be conducted to the optical waveguides.

16. A printing machine as defined in claim 1, and further comprising at least one modulator associated with each of the form cylinders so as to be in the beam path.

17. A printing machine as defined in claim 1, and further comprising an autofocus system associated with each of the form cylinders so as to be in the beam path.

18. A printing machine as defined in claim 1, and further comprising a preheating unit, movable together with the laser unit, associated with one of the form cylinders so as to heat a material on a surface of the form cylinder to be imaged to an energy level slightly below an energy level needed for application of image information, which needed level is exceeded only by the laser pulses.

19. A printing machine as defined in claim 1, and further comprising a divider arranged so as to produce a plurality of partial beams from a laser beam emerging from the laser unit in keeping with the number of form cylinders to be imaged, still further comprising a separate modulator for each partial beam in keeping with an image to be produced on the given form cylinder, so that the form cylinders can be imaged simultaneously, and additionally comprising focusing means associated with each of the form cylinders.

20. A printing machine as defined in claim 1, wherein the light diversion means includes an optical divider.

* * * * *